United States Patent [19]

Obeck

[11] Patent Number: 4,573,049

[45] Date of Patent: Feb. 25, 1986

[54] TRAFFIC SIGNAL LIGHT CONTROL FOR EMERGENCY VEHICLES

[75] Inventor: Carl J. Obeck, Pompano Beach, Fla.

[73] Assignee: Bourse Trading Company, Ltd., Philadelphia, Pa.

[21] Appl. No.: 487,247

[22] Filed: Apr. 21, 1983

[51] Int. Cl.[4] ..... G08G 1/07

[52] U.S. Cl. ..... 340/924; 340/825.69; 340/825.72; 340/906

[58] Field of Search ..... 340/906, 825.72, 825.69, 340/909, 910, 911, 924

[56] References Cited

U.S. PATENT DOCUMENTS

| | | | |
|---|---|---|---|
| 2,355,607 | 8/1944 | Shepherd | 177/337 |
| 3,209,325 | 9/1965 | Mentzer et al. | 340/825.72 X |
| 3,247,482 | 4/1966 | Lesher | 340/41 |
| 3,257,641 | 6/1966 | Campana et al. | 340/33 |
| 3,881,169 | 4/1975 | Malach | 340/32 |
| 4,016,532 | 4/1977 | Rose | 340/32 |
| 4,135,144 | 1/1979 | Elmasian | 340/32 |
| 4,463,339 | 7/1984 | Frick et al. | 340/906 |

*Primary Examiner*—Ulysses Weldon

*Attorney, Agent, or Firm*—Oltman and Flynn

[57] ABSTRACT

A traffic light control system which includes two-way communications between a moving emergency vehicle approaching a busy intersection with one or more traffic lights, arranged so that the traffic light control apparatus has stored therein preset patterns of response that temporarily preempt the usual operation of the traffic light and instead provides the most effective method of routing the vehicle through the intersection while redirecting general traffic. As part of the invention, the traffic light control mechanism returns acknowledgement of receipt of instructions to the emergency vehicle. The stored preset traffic patterns may in one embodiment be responsive to human intervention from a dispatching center or to time-of-day conditions. The stored traffic patterns in still another embodiment may be arranged to include a plurality of coordinated intersections. In still another embodiment, the traffic light control apparatus may be operated under control of data or voice transmitted from the emergency vehicle's regular two-way voice communications system to a central, attended control station.

6 Claims, 9 Drawing Figures

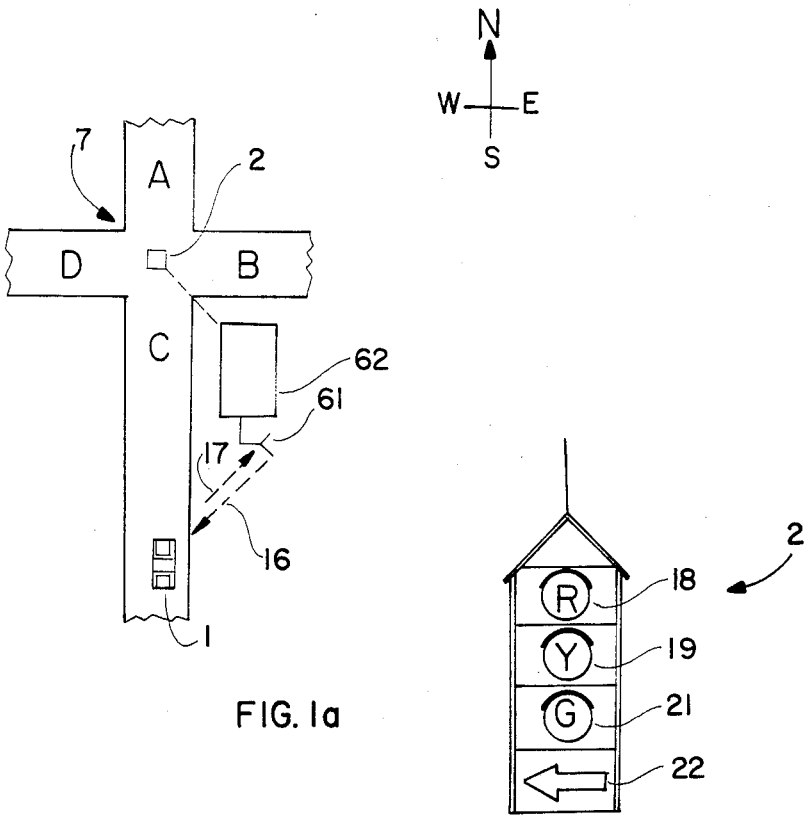
FIG. 1a
FIG. 1b
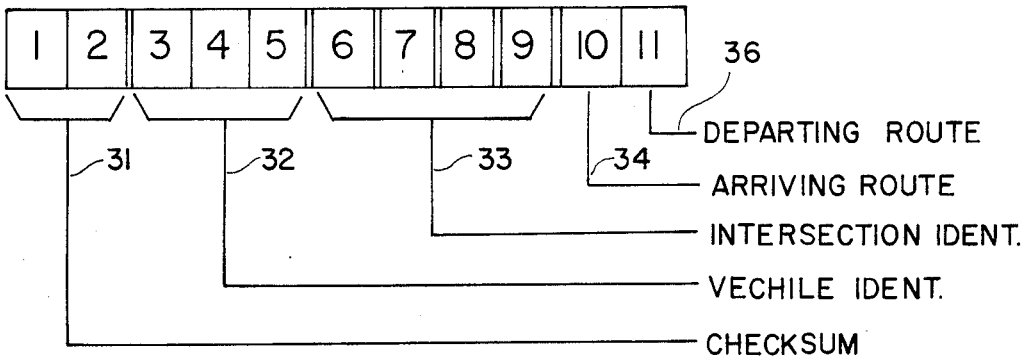
FIG. 3

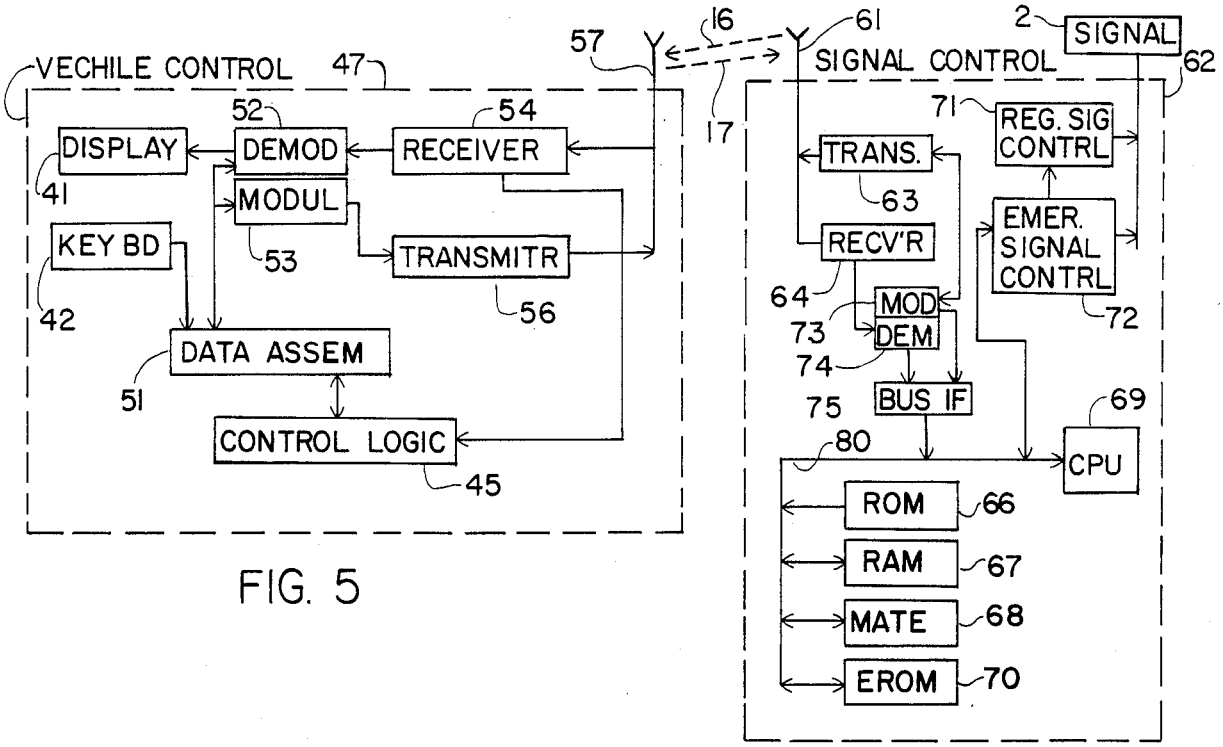
FIG. 5
FIG. 6
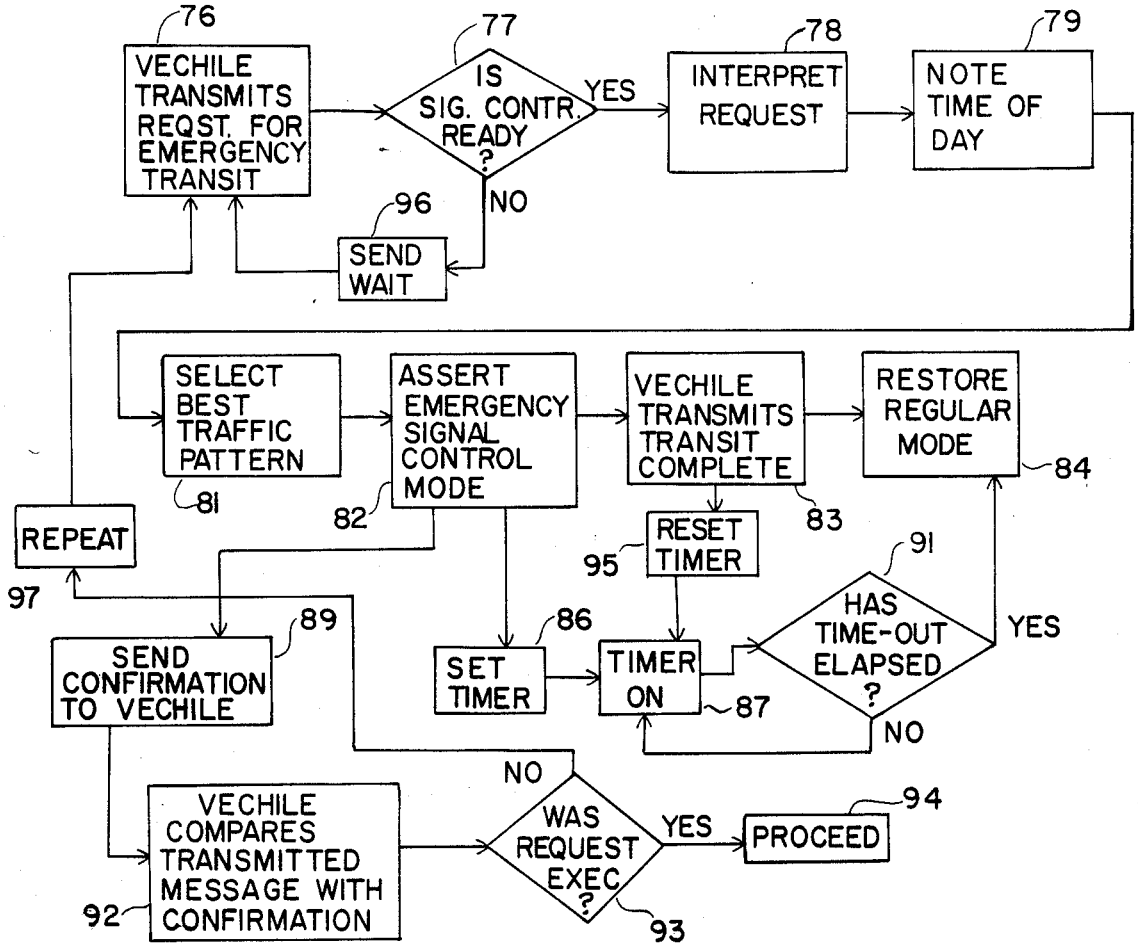

TRAFFIC SIGNAL LIGHT CONTROL FOR EMERGENCY VEHICLES

BACKGROUND AND PRIOR ART

The invention belongs to the field of traffic controls, and more specifically, to the control of road faring vehicle traffic in connection with emergency vehicle traffic.

Whenever an emergency vehicle is traveling under conditions of urgency, the problem of passing through busy street intersections represents a dangerous problem to both the emergency vehicle and to the general traffic at or in the vicinity of the intersection. The problem has become especially severe in recent years when many drivers travel in air conditioned cars with their windows rolled up and often with the radio turned on so that they may be unable to hear the siren of an approaching emergency vehicle. Many serious accidents happen each year as a result of collisions between emergency vehicles and other traffic. In heavy city traffic there is still another problem in relation to the travel of emergency vehicles. As an emergency vehicle approaches a busy intersection and some of the drivers respond to the siren and pull to the curb and halt, as required, busy intersections become filled with vehicles standing still and often completely block the progress of the emergency vehicle. Many inventors have in the past sought to devise practical solutions to these problems.

J. O. D. Shepherd, U.S. Pat. No. 2,355,607 issued August, 1944 discloses a system providing radio transmitters mounted on emergency vehicles that radiate a signal that is detected by direction sensitive receivers at the traffic signals and sets the signals such as to admit the emergency vehicle.

F. C. Campana et al, U.S. Pat. No. 3,257,641 issued June 1966 also discloses a system where a vehicle-mounted radio transmitter sets traffic signals to a special emergency light condition that halts all other traffic.

J. C. Lesher, U.S. Pat. No. 3,247,482, issued April 1966 discloses a system where an emergency vehicle-mounted radio transmitter broadcasts simultaneously two subcarrier signals which prevent interference of two vehicles simultaneously attempting to control the traffic lights.

Other inventors have disclosed systems that employ sonic or light microwave radio signals in order to control the traffic lights.

H. G. Malach, U.S. Pat. No. 3,881,169, issued April 1975 discloses a system where each intersection has sonic receivers tuned to certain sound frequencies transmitted by an approaching emergency vehicle, so as to direct the traffic lights to guide the vehicle through the intersection.

L. L. Rose, U.S. Pat. No. 4,016,532 issued April 1977 discloses a system in which an emergency vehicle mounted transmitter sends a coded signal to a receiver at the intersection where it causes the traffic signal at the intersection to turn to steady red in all directions.

E. Elmasian, U.S. Pat. No. 4,135,144, issued January 1979 discloses a system in which a radio transmitter mounted in the emergency vehicle causes a receiver at the signal to initiate a light signal sequence that causes the signal to first send flashing red in all directions before turning steady red in all directions.

It appears that none of the systems of the prior art have completely solved the problem of coordinating and controlling traffic so as to accommodate an emergency vehicle in transit since none have gained wide acceptance.

The main problems, it has been found, reside in the fact that city intersections are often very complex in their physical layout and often several intersections are mutually interacting as heavy traffic flows from one traffic direction to another through such inter-related busy intersections. Additionally, the pattern of traffic flow often changes during the day, such that morning rush hour traffic, for example, is different from evening hour rush traffic.

The present invention overcomes these problems by providing a two-way interactive encoded communications link between signal controls at an intersection and emergency vehicles, where in vehicle-mounted communications apparatus transmits, from an approaching emergency vehicle, a digitally encoded message to communications and control apparatus associated with a single traffic intersection or with complicated groups of intersections, that transmits to the control apparatus the identity of the vehicle followed by the desired route through the intersection. The control apparatus at the intersection, in response, inserts the request into an electronic memory bank, residing at the control apparatus, or associated therewith, which in turn provides one of a number of preselected optimal patterns for that intersection, so that the traffic control quickly may clear all traffic lanes to be used by the emergency vehicle instead of blocking them with stalled traffic. The traffic control additionally returns a confirmation code to the emergency vehicle that tells the driver that his request has been received and that he can safely proceed through the intersection.

OBJECTIVES

It is a primary object of the invention to provide an emergency vehicle traffic control system that uses two-way communication links between emergency vehicles and traffic control apparatus at intersections such that encoded signals from the vehicle informs the control apparatus of the desired route through the intersection, and wherein preselected optimal traffic signal patterns are stored in a memory bank to provide the best possible path for an emergency vehicle through that intersection.

It is another important object to provide an emergency vehicle traffic control system that returns a response to the driver that confirms that his request has been received and is being executed by the signal control apparatus.

It is still another important object to provide an emergency vehicle traffic control system that is adaptable to changing traffic conditions such as morning and evening rush hour traffic.

It is still another important object to provide an emergency vehicle traffic control system that insures against interference between several vehicles operating within the same area at the same time.

It is still another object to provide an emergency vehicle traffic control system that can use the two-way radio equipment already installed in the vehicle for the traffic light control.

It is still another object to provide an emergency vehicle traffic control system that allows human intervention under unusual circumstances.

Still other objectives and advantages will become clear in the course of the following detailed description with appended figures and claims.

BRIEF DESCRIPTION OF THE FIGURES

FIG. 1*a* is a diagrammatic "birds-eye" view of an intersection with local emergency traffic control, with an approaching emergency vehicle and the communication links between them.

FIG. 1*b* is a traffic light;

FIG. 3 is a diagram of a digitally encoded message format used with the invention;

FIG. 5 is a diagram of the major function blocks in the vehicle control apparatus and signal control apparatus;

FIG. 6 is a flow-chart diagram of the steps performed by the vehicle and the intersection control apparatus in the execution of a request for transit.

DETAILED DESCRIPTION

Figure 1C:
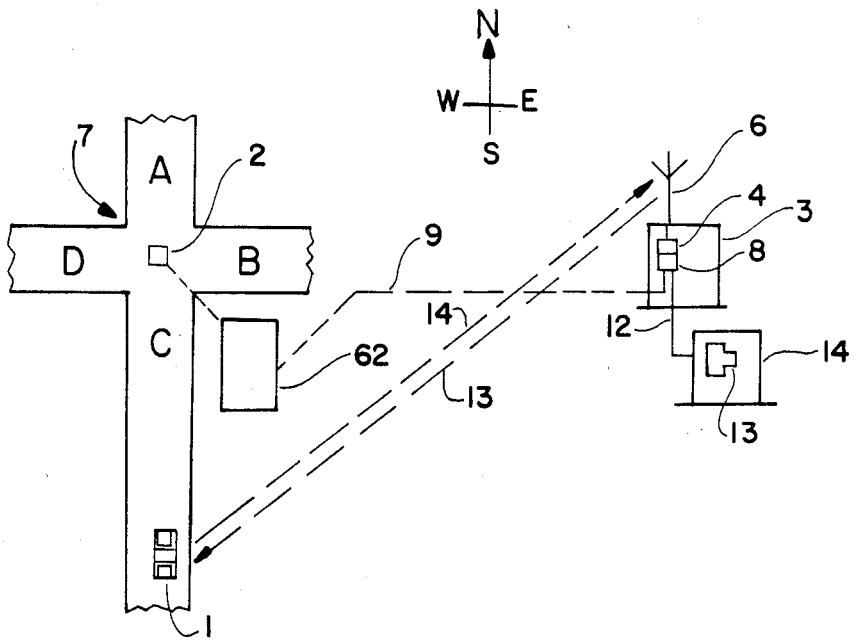
FIG. 1*c* is an embodiment having central control, from a central control station, of the traffic light.

In the following, a number of preferred embodiments of the invention have been described in detail in relation to the appended drawings. It is to be understood that the invention is capable of other embodiments and is not limited in its application to the details of the particular arrangements shown.

The terminology used therein is for the purpose of description and not of limitation.

Wherever gender is used, the male gender is used to represent both genders.

The term "driver" is used to represent the person or persons in the vehicle operating the vehicle and the traffic control apparatus.

FIG. 1*a* is a "birds-eye" view of a simple intersection consisting of four branches at generally right angles to one another. The branches are designated A,B,C, and D in clockwise direction with branch A pointing North. That convention is used throughout this specification to designate branches to intersections. A traffic signal 2 is suspended above the center of the intersection as is often used in relatively simple cases such as this. A signal control 62, located near the intersection, comprises the apparatus used in connection with the operation of the traffic signal, such as electrical relays with contacts to control the lights, power connections to the main ac-power source, and sequencing apparatus that controls the successive phases of traffic lights. The control also includes the traffic light emergency control apparatus in accordance with the present invention. FIG. 1*b* shows a conventional simple four-sided traffic signal as is commonly used. Each of its four sides has sectors consisting of a red light 18 at the top signalling approaching traffic to stop when facing the red light, a yellow signal 19 in the middle, warning that red is coming next and a green light 21 at the bottom signalling approaching traffic facing the green light permission to proceed. A fourth section 22 at the bottom showing a green arrow is at times used to indicate that left turn or other special conditions are permitted. At some locations multiple signals are located over divided traffic lanes to indicate different turn modes for the different lanes of traffic. There is a great variety in the different ways traffic signals are displayed in different localities, depending on local preferences and policies. It is not necessary to describe these differences in more detail, since the invention is not directed to modes in which the signals are deployed per se, but to the methods used to select and deploy the modes that are preferred in directing emergency vehicles through busy intersections.

Figure 4:
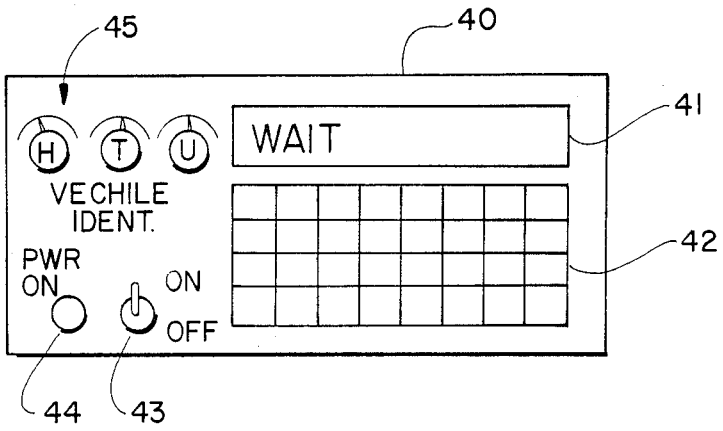
FIG. 4 is a diagrammatic view of an emergency vehicle control console as used with the invention showing the major function blocks and their interconnections.

In FIG. 1*a*, as the emergency vehicle 1 approaches the intersection from the South on branch C, the driver has turned on his traffic control console 40 shown in FIG. 4 by operating its on-off switch 43 and the "power-on" light 44 indicates power is on. In accordance with the invention each vehicle authorized to operate in the area or jurisdiction of the particular intersection has a unique identity number, which may typically be a three digit number which has been dialed into the three dials generally at 45, consisting of the hundreds digit H, tens digit T and units digit U. These dials may, if merited, be placed under a locked cover and inaccessible to the operating personnel. An alpha-numeric keyboard 42 is used to first key in the identity number or designation code of the intersection being approached together with the branch of ingress to the intersection and the branch of egress requested. It is assumed that the driver has in his possession a chart that shows the identity number or code of the intersections in his area of jurisdiction or has memorized these designations. It should be noted that all the designations could be allocated mnemonic codes as they are now widely used in data systems in order to facilitate the use of the system. The details of coding is, however, immaterial to the inventive concept.

As a result, the vehicle control apparatus 47 in FIG. 5 records the above information from the keyboard 42 and stores it in digital code in the data assembler 51. The data assembler prepares a small "packet" or record of information consisting of the characters keyed in and assembles them in a selected sequence so that it can be transmitted serially as a string of characters from the vehicle. The codes used for character transmission is immaterial; the most generally used code is the so-called ASCII code which is described in textbooks on data transmission such as Computer Organization and Programming by William Gear, published by McGraw Hill Library of Congress Catalog No. ISBN 0-07-023076-5 and Digital Systems: Hardware Organization and Design by Frederick J. Hill et al published by John Wiley & Sons, Library of Congress No. ISBN 0-471-39605-2.

FIG. 3 shows the format of this information packet consisting of eleven numbered boxes, 1–11. Starting from right to left, box No. 11 represents the departing branch. Assuming that the driver intends to leave at branch D after having made a left hand turn from C, it would contain a "D" in box 11 and a "C" in box 10. Assuming the intersection has identity number 6789, these numerals would be stored in boxes No. 6 through 9. The vehicle identity number would be stored in boxes Nos. 3, 4 and 5. After the characters are assembled in the data assembler 51, a so-called check-sum may be computed by the data assembler. The check-sum is typically the number of "ones" (1's) in the assembled character string contained in the spaces 3 through 11 as they are converted to ASCII code. In the ASCII code format each character consists of an eight bit binary number, which is, again, a string of eight ones or zeroes (1's or 0's). After the character string has been assembled in the format shown in FIG. 3, it is sent to a modulator 53 which modulates a tone frequency that is frequency keyed in two discrete frequencies to produce the ones and zeroes in accordance with industry standards.

The modulator is part of a so-called modem which is typically a modulator-demodulator (MODEM) combined into one piece of hardware, with the demodulator 52. The modulator 53 will, when the data assembler 51 is ready, turn on the transmitter 56 which is a radio frequency generator producing a radio carrier in one of the frequency bands allocated for applications of this nature by the Federal Communications Commission (FCC). The transmitter may now be frequency-shift keyed by the modulator and transmits the character string consisting of the 11 characters of FIG. 3 preferably in the numbered sequence. Before transmitting its carrier, however, it is advantageous that the modulator waits until it has checked to see if the radio frequency used is available; in other words, if no other vehicle or traffic signal is currently using the same assigned radio frequency. This function is performed by the demodulator 52 which receives the radio carrier signal from the receiver 54, if the frequency is in use. It should be understood that preferably the invention uses the same frequency for transmissions from vehicle to signal and vice versa. Assuming the frequency is available, at that moment the transmitter will turn on the carrier frequency which could, typically, be in the 180 megaherz range. The transmitter will be modulated in rapid succession by the one's and zero's of the character string of FIG. 3, which with 11 characters each with 8 bits represent 88 bits. The transmitter will typically operate in the frequency modulation mode so that the frequency modulated audio signal from the modulator operates to frequency-shift modulate the radio carrier produced by the transmitter. The transmitter is connected to an antenna 57 mounted on the vehicle, and transmits the character string to the distant antenna 61 located at the intersection signal control 62, where it is received by the receiver 64. As soon as the message is transmitted, the transmitter at the vehicle turns off its carrier. The transmission may typically take a small fraction of a second at a carrier frequency above 30 megaherz.

The signal control apparatus at the intersection having now received the request from the emergency vehicle with the information containing the identity of the vehicle and the driver's path of transit through intersection proceeds to execute the request.

The dashed line box 62 of FIG. 5 shows the major function blocks of the signal control apparatus. The receiver 64, already mentioned, sends the received character string of 88 characters through the demodulator part (DEM) 74 of a modem 74, 73, also containing the modulator 73 (MOD).

The modem here performs a function that is similar to that of the modem 52, 53 in the vehicle control 47. The digital, binary character string produced by the demodulator is sent to a bus interface (BUS IF) 75 which communicates with a digital bus 80 which is, in turn, a part of a micro-processor control system consisting of the central processing unit (CPU) 69, memory section consisting of the read-only memory (ROM) 66, the random access memory (RAM) 67 and a maintenance test unit (MA-TE) 68 and the electronically alterable ROM, the EROM 70.

Figure 7:
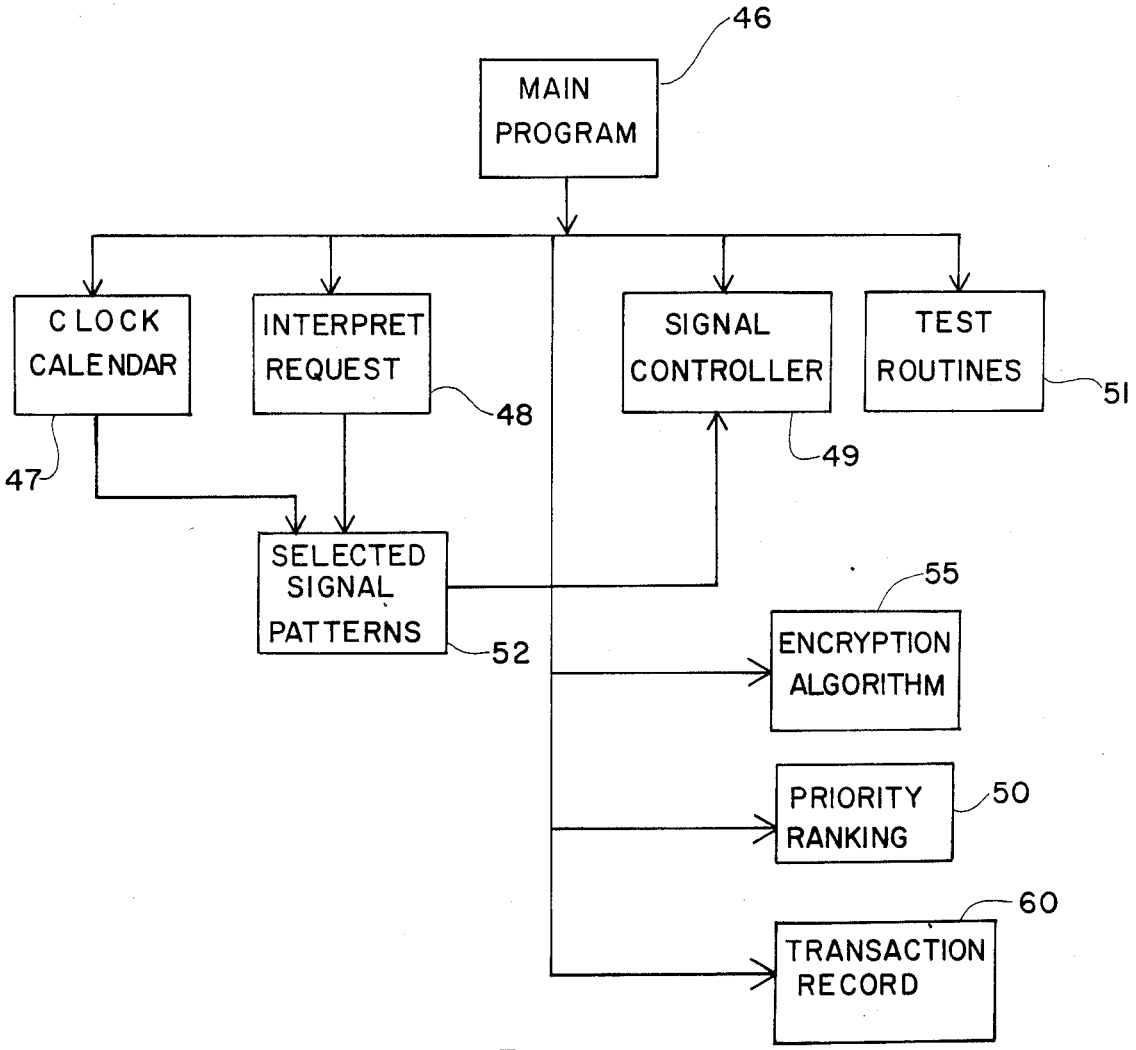
FIG. 7 is a diagrammatic layout of the program modules of the control program.

Microprocessor systems contain a microprocessor unit (CPU) that is connected with memory sections. The memory sections contain all control programs in binary coded numbers. Each memory section consists of memory cells, each of which may exist in two states, namely as a "one" or a "zero", also designated "on" or "off", respectively. The ROM memory 66 contains, in stored digitally encoded form, the control programs which constitute the control functions for the control system. The RAM memory 67 contains transitory information which the CPU requires in order to perform its operations. The control programs in memory are subdivided into smaller sub-sections or modules, each having discrete, defined functions within the entire control system. FIG. 7 shows the more significant sub-sections of the control program and is described in greater detail below.

The control programs consist of sequentially numbered listings of digitally encoded instructions that are stored in the memory. The instruction format and encoding is part of the instruction set which is again a part of the structure of the microprocessor, as originally established by the designer of the microcomputer. The control programs, acting through the hardware of the microprocessor, are capable of operating on and monitoring other sections of hardware which are part of the entire control system.

The ROM 66 contains the control programs that are rarely changed. The RAM 67 contains program information that is transitory and changes frequently. The maintenance-test unit 68 MA-TE contains programs and hardware that monitor the operation of the system and produces an alarm that may be transmitted to a remote, attended location if equipment malfunctions are detected.

The lights in the signal 2 are operated by a regular signal control 71 which performs the continuous, periodic sequencing of the lights during normal traffic conditions. It may contain conventional hard-wired logic components, as in most older systems, or it may be controlled by the CPU 69 over the bus 80 as in newer systems. Whichever method of operation is used for this function is immaterial in view of the invention.

An emergency signal control 72 takes over the light control in case an emergency vehicle request is being executed by the signal control, and is, for this purpose, connected to the CPU bus 80. In this case, the operation of the regular signal control 71 is pre-empted.

The operation of the signal control 62 is shown in functional steps in the flow chart of FIG. 6, which traces the steps in the execution of an emergency request.

The symbols of the flow chart are conventional and standard and are described in reference books on control systems, as in aforesaid referenced sources.

The first step 76 is the request for an emergency transit through the intersection. The next step is the decision point 77. If the signal control 62 is engaged in the execution of a request from another emergency vehicle a "WAIT" message 96 will be sent back to the vehicle through the NO branch at 77. If the signal control is ready to execute the request, the next step 78 is to interpret the information in the received request message. As part of the interpretation, the validity of the request message is checked including the validity of the vehicle identity number. Next the time of the day is noted in step 79 and based on this, a predetermined, stored emergency traffic pattern is selected from a library of such patterns stored in ROM 66 or EROM 70 in step 81. The emergency traffic pattern places the system in the emergency signal control mode in step 82 which affords the emergency vehicle safe transit through the intersection. After completing the transit, the emergency vehicle driver will normally execute a "Transit-Complete" message as in step 83, which will restore operation to the regular mode in step 84. He might, however, happen to neglect to issue that message and a timing function 86 that was started at the beginning of the request starts a timer in 87. If the "Transit-Complete" message is received, the timer 87 is reset in 95, but if not, the "Timer On" 87 goes to the decision point 91. If the time-out period has elapsed, the "Yes" branch restores normal operation in 84, but if time-out has not elapsed, the "No" branch continues the timer.

At the start of the execution of the emergency signal control mode in step 82, the received message is transmitted back to the emergency vehicle control in step 89. The vehicle control 47 compares the returned message with the original message in step 92 that tells the vehicle control 47 that the signal had received the message as transmitted and started the execution of the request. The comparison is done at the vehicle in step 93, which is a decision point. If the comparison affirms the message, the "Yes" branch from 93 goes to step 94, which produces a "Proceed" message in the vehicle that tells the driver that he may proceed safely. In case step 93 is negative indicating that the message returned was not the same as transmitted, the "No" branch from step 93 produces a "Repeat" message 97 at the vehicle which is displayed at the control console and tells the driver that something is amiss. He may then repeat the request or take different action at his discretion.

The vehicle control 47 as shown in block diagram in FIG. 5 contains a control logic unit 45 which provides the internal vehicle control logic functions that correspond to those performed by the control processor in the signal control 62, except it will have a different control program and will typically have less complexity. The basic operational steps of the control logic 45 were included in the flow chart of FIG. 6. It follows that several additional functions may be included in the construction, such as self tests, diagnostic tests and others which are conventional and are typically included in such systems and which are well known to those skilled in the art of designing control logic systems.

In FIG. 4, the display 41 and keyboard 42 are parts of the vehicle console 40 shown in FIG. 4. The display 41 is capable of displaying messages such as "Proceed" or "Wait" or "Repeat" to the driver as appropriate or maintenance and systems status messages to inform the driver of the system status. The keyboard 42 is typically an alpha-numerical board as used on a conventional type writer or it may be abbreviated to include only the keys required to send the special messages labeled thereon and the numeric keys. Such an abbreviated keyboard will have less capability, but may be less expensive and occupy less space in the vehicle cab.

The control programs which are stored in the central processor's memory sections are organized in smaller sections typically called modules. The major modules of the control program are shown in FIG. 7. A main program 46 ties together and coordinates the operation of the individual modules. The Clock Calendar 47*a* which produces time of day and the date, the Interpret Request module 48 receives the request information in the format shown in FIG. 3, organizes and validates it, if applicable, and transmits it to the Emergency Signal Patterns module 52*a* which produces a preselected signal pattern which it transmits to the Signal Controller module 49, which transmits the control commands to the Emergency Signal Control block 72 in FIG. 5.

A test routine module 51 continuously monitors the operation of the entire system and indicates any malfunctions it detects and decides, if applicable, what action to take, in order to correct the malfunction.

In a second embodiment of the invention, shown in FIG. 1*c*, the vehicle 1 does not communicate directly with the signal control 62 as described above but with a central control 3 which may be located at some central location from where it may serve a plurality of traffic signals. In the latter case, the vehicle radio equipment communicates via a two-way link 13,14 with two-way radio equipment 4,8 connected to an antenna 6 at the central location 3. A wire communication link 9 is then provided to connect the central control 3 with the signal control 62, instead of the radio link 16,17 used in the first embodiment.

A system structured in this way has the advantages that the vehicle's normal two-way voice communications system, which is normally more powerful and farther reaching than a small dedicated separate two-way radio provided for signal control only, and is already normally provided in most emergency vehicles for general voice communications. Furthermore, the maintenance of a single central radio system is often more desirable and reliable than the maintenance of multiple, distributed small units, and a wire link such as provided in this embodiment is very reliable and economical and may readily be used also to transmit equipment alarms and malfunctions back to a central, attended location.

It has the additional advantage that human intervention may be added to the centrally located system by the addition of an operator console 13 connected to the centrally located control 3 via a link 12 in an adjacent or another remote location 14. The human operator may be equipped to override the decisions made by the automatic equipment. He may also be able to control the signals in response to verbal requests from an emergency vehicle in cases in which the automatic vehicle control is not functional or not installed.

In the second embodiment different modes of operation may be provided relating to the interactions between the central control unit 3 and the signal control 62. In one of the preferred modes, the central control 3 receives the character string and transmits the confirmation over the radio link (13,14), as did the radio receiver and transmitter in the signal control 62 in the first preferred embodiment. In the second embodiment that information is then transmitted via the wire link 9, to and from the signal control 62 which still has residing with it, as in the first embodiment, the function blocks pertaining to central processor, memories, signal controls, memories, modem and bus interface 75, as described under the first embodiment.

In the case of the added human intervention with a console 13, the human operator can receive verbally the request for transit through an intersection from an emergency vehicle and from his console, that may be similar to the vehicle console of FIG. 4, activate the emergency signal control mode.

It follows, that with the second embodiment, if human intervention is provided a fleet of emergency vehicles may contain vehicles that do not have a vehicle control 47 installed. In this way, an economical gradual transition can be made from a manual system to a system that is fully automatic.

Figure 2:
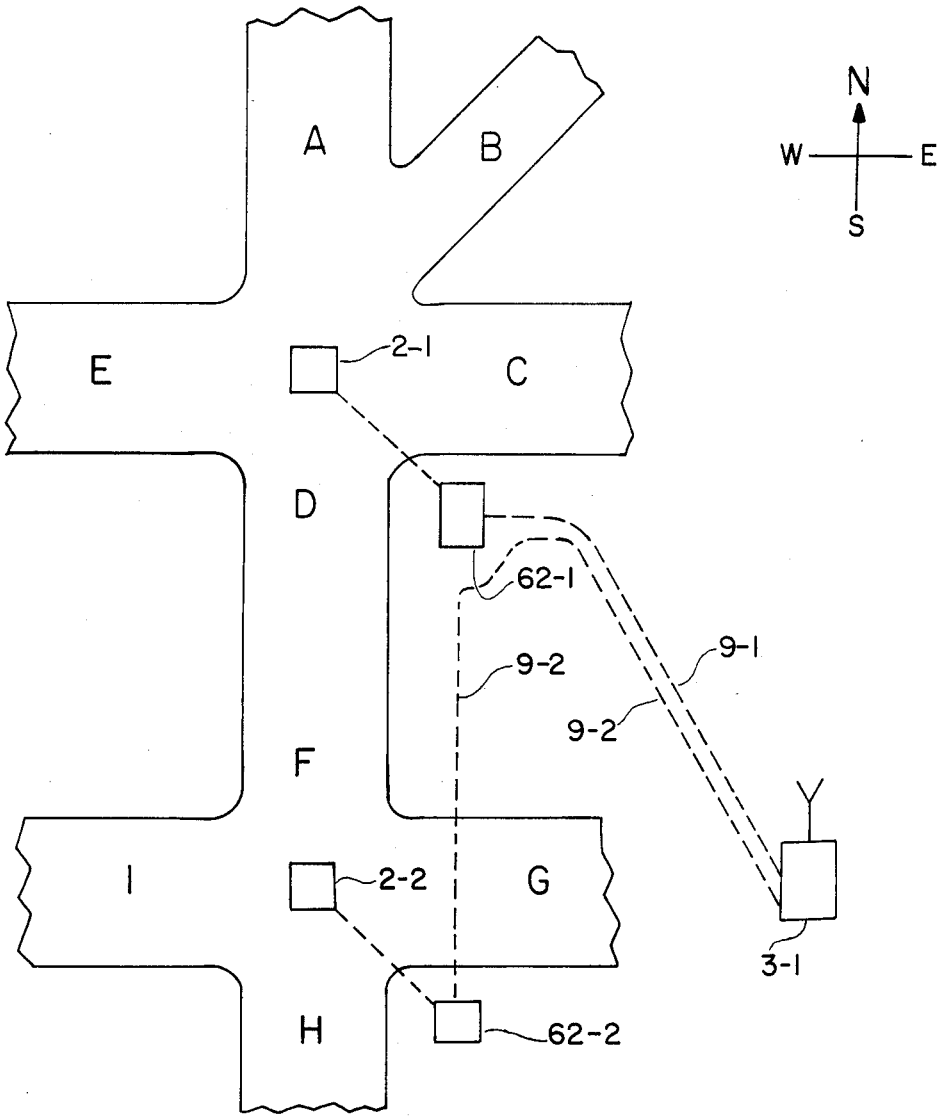
FIG. 2 is a diagrammatic "birds-eye" view of a complex intersection with several traffic signals and traffic patterns and linked traffic controls.

It follows that the present invention may be embodied such that smaller groupings of street intersections that share a centrally located control may be created by a combination of the elements of the first and of the second embodiment. Such an arrangement may be advantageous in large complex intersections consisting of several interacting smaller junctions, as shown in diagrammatic form in FIG. 2, where two intersections, the main intersection with branches A,B,C,D,E and a smaller intersection with branches F,G,H and I to the South. The main intersection has a main signal control 62-1 with an attached second control 62-2, both being served by a central control 3-1 which contains the radio equipment. Two wire links 9-1 and 9-2 serve the two signal controls 62-1 and 62-2 respectively.

OTHER EMBODIMENTS AND CAPABILITIES

In the foregoing specification two preferred embodiments of the invention have been described. As explained, the preferred mode of operation employs an interactive method of two-way radio transmissions between a traffic light control and an emergency vehicle where all units, vehicular as well as stationary transmit short bursts of digitally encoded radio messages, all on the same frequency. The communications protocol provides that any unit, before it transmits a message insures that the frequency is available. If two units should transmit at the same time, or there is other interference, a check-sum embedded in the message informs the receiving unit that the message transmitted is incomplete and confirmation is not returned. If confirmation is not returned, the first transmitting unit, after a random delay, may repeat the message, and the probability is very small that a second attempt will fail, or that a third should fail and so forth, after repeated attempts.

The traffic signal light control of intersections according to the invention affords a high degree of protection against interference of the light control from simultaneous operation of several emergency vehicles, in the same general area because the first vehicle seizing control of the light delivers to the signal control the unique identity of that vehicle where it is stored in its electronic memory, for the duration of the execution of the vehicle's transit through the intersection. In the second embodiment, employing central control of the signals, both the vehicle identity and the intersection identity is known to the control apparatus and nearly simultaneous requests can be separated by the control apparatus.

The traffic signal control of the invention has the significant advantage that no special light signals are required which could confuse drivers of the general traffic or out-of-town drivers.

In the second embodiment with human intervention it is possible to accommodate special traffic conditions that emerge in unusual situations which could not have been predicted, such as large fires, civil disturbances and catastrophies and so forth.

The signal light control, according to the invention, affords the capability of adding encryption of the encoding of the character strings used in the system for two-way communications. Such encryption eliminates or reduces the dangers from malicious interference with the system. Encrypting algorithms are now readily available, which provide a high degree of integrity of the transmissions. Encryption algorithms would in this case be added to the control programs in both the vehicle control and the signal control. In FIG. 7 an encryption algorithm module 55 is shown, under the main program.

The signal light control system according to the invention affords a simple means for adding rank or priority to different emergency vehicles by adding priority ranking to the vehicle identity code. Such a ranking table could be built into the control program at the signal control. In FIG. 7 a priority ranking module 50 is shown which inserts the vehicle identity code into the ranking table and allocates competing requests for transit in accordance with the priority ranking of the vehicle.

The signal light control, according to the invention affords a simple method of recording the time and vehicle identity of each emergency vehicle transit through the intersection by the expedient of not erasing such information after transit is completed but by means of storing it, either in a transaction memory module provided for the purpose, as shown as transaction record at 60 in FIG. 7. This memory module may then, later, be interrogated by the attachment of a paper printer or other display device. Such records may be of value in later evaluation of the efficiency of the selected control patterns stored in the selected signal pattern module 52 or may be valuable in the settling of the question of when transit took place.

The memory module provided for storing past operations is shown as the Transaction Record 60 in FIG. 7.

I claim:

1. Traffic signal light control system for emergency vehicles, comprising:

a plurality of traffic signal lights for directing traffic through a plurality of street intersections;

at least one emergency vehicle, having a vehicle identity code;

emergency vehicle traffic control apparatus disposed in said emergency vehicle;

a plurality of traffic signal light control apparatus equal to said plurality of traffic lights, each disposed in the vicinity of a respective traffic signal light for controlling it;

central control apparatus disposed in a spaced-away location from said plurality of said traffic signal light control apparatus;

a plurality of wire communication links equal to said plurality of traffic signal light control apparatus, connecting said central control with a respective traffic signal light control apparatus;

two-way radio communications link which includes a vehicle radio receiver-transmitter in the emergency vehicle connected with the emergency vehicle traffic control apparatus and a fixed radio receiver-transmitter, all receiver-transmitters using the same frequency, and the fixed receiver-transmitter operatively connected with the central control apparatus;

emergency vehicle control console disposed in said emergency vehicle operatively engaging said emergency vehicle traffic control apparatus, for receiving a command which includes the vehicle's identity;

said signal control apparatus comprising a central processing unit having electronic memory, at least one selected signal pattern and a control program stored in said electronic memory and being responsive to said command which is received from said emergency vehicle via said two-way radio communications link, said central control and said wire communications link for activating said selected signal pattern for guiding the emergency vehicle through the intersection.

2. Traffic signal light control according to claim 1 further comprising a second command from said traffic signal light control apparatus, transmitted via said wire communications link via said two-way radio communications link, via said emergency vehicle traffic control apparatus to said vehicle control console to indicate to the vehicle driver that the first command has been executed.

3. Traffic signal light control system according to claim 1 further comprising an operator console connected to the central control for manually controlling the traffic lights.

4. Traffic signal light control system according to claim 1, further comprising a priority module stored in said electronic memory for setting priority ranking for said emergency vehicle.

5. Traffic signal light control system as defined in claim 1 further comprising:

an encryption module stored in said emergency vehicle control apparatus for encrypting said first command from clear data to encrypted data;

an encryption module stored in said electronic memory for converting said encrypted data back to clear data;

a transaction record module for storing time and vehicle identity of each emergency transit through the intersection.

6. Traffic signal light control system as defined in claim 1 further comprising a central control operator console, for providing human intervention in the emergency control of said traffic lights.

* * * * *